United States Patent [19]

Slenker

[11] Patent Number: 5,038,017

[45] Date of Patent: Aug. 6, 1991

[54] BATTERY PACK

[76] Inventor: Stephen Slenker, 26 Cummings Rd., Tyngsboro, Mass. 01879

[21] Appl. No.: 484,070

[22] Filed: Feb. 13, 1990

[51] Int. Cl.[5] ..... A43B 7/04

[52] U.S. Cl. ..... 219/211; 200/52 R

[58] Field of Search ..... 219/211, 527; 200/551, 200/547, 60, 16 R, 52 R; 36/2.6, 117; 320/2; 429/96-100

[56] References Cited

U.S. PATENT DOCUMENTS

| | | | |
|---|---|---|---|
| 1,933,243 | 10/1933 | DeMerolis | 219/211 |
| 2,692,326 | 10/1954 | Crowell | 219/211 |
| 3,859,496 | 1/1975 | Giese | 219/211 |
| 3,977,093 | 8/1976 | Santroch | 36/2.6 |
| 4,080,971 | 3/1978 | Leeper | 219/211 |
| 4,507,877 | 4/1985 | Vaccari et al. | 36/2.6 |
| 4,798,933 | 1/1989 | Annovi | 219/211 |
| 4,950,858 | 8/1990 | Slenker | 219/211 |

*Primary Examiner*—Teresa J. Walberg

*Attorney, Agent, or Firm*—Wolf, Greenfield & Sacks

[57] ABSTRACT

A battery pack for footwear heaters is shown employing spring like electrical contact elements wherein one element is brought into and out of contact with a fixed electrical contact by means of a sliding cam switch or a rotary cam switch, with means for inhibiting water penetration. The battery pack is provided with a trimmable skirt for conforming its contour to the mounting surface on footwear.

11 Claims, 5 Drawing Sheets

BATTERY PACK

FIELD OF THE INVENTION

This invention is concerned with a battery pack for use with electrically heated footwear and is more particularly concerned with mounting and switching arrangements within such battery pack.

BACKGROUND OF THE INVENTION

It is well known to provide electric heating systems for ski boots and other footwear. Such devices are normally made available as kits for installation by the user, into footwear. In one such arrangement as shown in U.S. Pat. No. 4,507,877, issued on Apr. 2, 1985 to Vaccari, et al., batteries which provide the power for the heater element are located within a storage compartment accommodated inside the sole of a boot, with a control switch in the form of a toggle switch mounted at the top on the outside of the boot and electrically connected in a circuit with the battery. Other devices wherein the shoe incorporates batteries within it are shown in U.S. Pat. Nos. 4,798,933, issued Jan. 17, 1989 to Annovi and 3,977,093, issued Aug. 31, 1976 to Santroch. In both of these devices, a switching arrangement is in the form of a pushbutton switch is built into a portion of the shoe and either is manually operable or operable by the wearer moving his foot to actuate it.

Battery packs have been mounted externally of footwear wherein the heating elements are connected by electrical wires which run from the footwear externally to a battery pack. Such a device is shown, for example, in U.S. Pat. No. 4,088,971 issued Mar. 28, 1978 to Leeper. In that device, a battery pack consisting of two hinged halves for enclosing the battery is held together by a strap which is used to mount the battery pack to the calf of the leg of the wearer. The battery pack is provided with an externally pivotable switch which can be swung from a contact engaging position to a contact disengaging position. Being mounted externally of the battery pack such a device can be subjected to malfunction and damage because it is on the external surface of the battery pack and may be made inoperable due to rusting or dirt accumulation.

It has been further suggested to provide a battery pack which can be mounted on the heel area of a boot. Such a device is shown in U.S. Pat. No. 3,859,496, issued on Jan. 7, 1975 to Giese wherein a slide is mounted externally of the boot for supporting a battery carrying case. The slide is provided with electrical contacts to be engaged with the battery contacts and is electrically connected to the heating element within the boot. It is clear that in such an arrangement the slide contact means is subjected to the elements and may be damaged to the extent that the device becomes inoperable. In any event, while being worn, such a device is rather awkward to operate since the turning of the heater on and off is accomplished by positioning of the battery on the slide, and this requires the wearer to turn around and try to observe the mating of the battery elements with the slide contact.

SUMMARY OF THE INVENTION

It is therefore one object of the invention to provide a battery pack which may be mounted fixedly to footwear and which contains switch actuators which are readily accessible to the user.

It is a further object of the invention to provide a portable battery pack which may be fixedly mounted to a shoe or boot and which is provided with means for causing the mounting surface of the battery pack to conform more closely to the configuration of the area of the shoe or boot to which the battery pack is mounted.

A further object of the invention is to provide a battery pack for shoe or boot heaters which has a condition indicator which clearly informs a user of the condition of use or non-use of the heating element. A still further object of the invention is to provide a portable battery pack which is operable in wet conditions and which resists entry of water within the battery compartment.

These and further objects of the invention will become more readily apparent from a consideration of a more detailed description following hereafter.

BRIEF DESCRIPTION OF THE DRAWINGS

The portable battery pack for footwear heaters is illustrated in the accompanying drawings, in which.

DETAILED DESCRIPTION OF THE INVENTION

Figure 1:
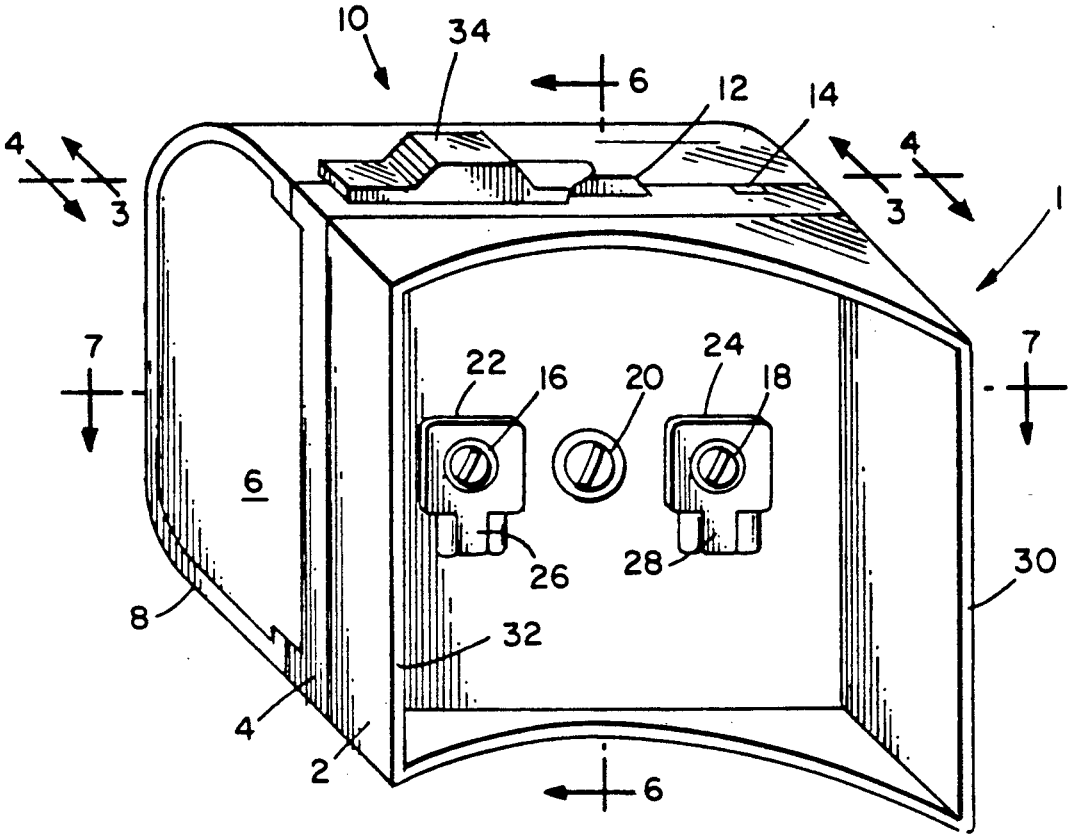
FIG. 1 is a perspective view of one embodiment of a battery pack according to the teaching of the invention.

As shown in FIG. 1, the battery pack 1 of the invention comprises several major components. A battery holder 6 is provided with a cover 8 to form a battery compartment. A slidable switch 10 is provided, which slides within switch track 12 formed in a base plate 4. Attached to the base plate 4 is a skirt member 2 which has two depending skirt sides 30 and 32, the side 32 being cutaway as shown in FIG. 1 in order to conform to the contours of the shoe to which the battery pack will be mounted. The upper right surface of the base plate 4 is provided with a switch position indicator 14. This may simply be a red square or it may be material embedded within the plastic base plate which has a red color, red being a desirable color to indicate when power is on. The battery has terminals (not shown) which are in electrical connection with the fastening screws 16 and 18. These screws secure the electrical connectors 22 and 24, which are provided with the female receptors 26 and 28 to receive blade elements of electrical conductor wire. A mounting screw 20 is provided which enables assembly of the battery pack to the footwear.

Figure 3:
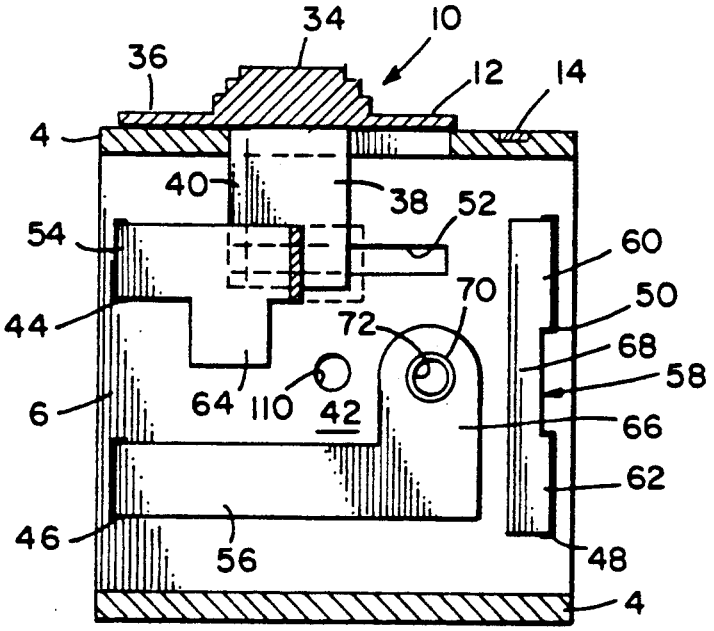
FIG. 3 is a cross-sectional view taken along line 3—3 of FIG. 1.
Figure 4:
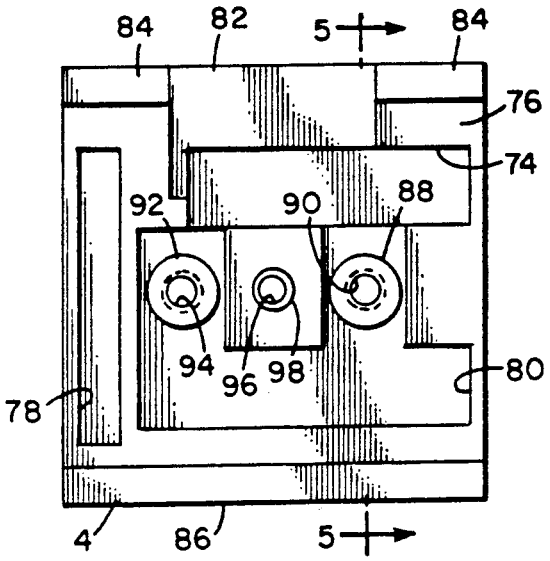
FIG. 4 is a cross-sectional view taken along line 4—4 of FIG. 1.

The nature of the slide switch arrangement shown in FIG. 1 will now be explained in greater detail in connection with the showing of FIG. 3, et. seq. As shown in FIG. 3, the switch 10 consists of a switch knob 34 formed on the top of a switch body 36 which is an elongated generally rectangular configured element. Depending from the switch body 36 is a switch blade 38 which is generally in a thin rectangular configuration. The edge 40 of the switch blade 38 is tapered for a purpose which is described more fully hereinafter. The front surface 42 of the battery holder 6 is provided with a series of slots 44, 46, 48, 50 and 52. As shown more clearly in FIG. 2, a series of electrical contact elements are provided such as the blade contact elements 54 and 56, and the contact spring 58. In actuality, all three contact elements perform a spring function to aid in retaining batteries. The contact element 54 is bent into an L shape so that one leg 117 extends through the slot 44 into the battery compartment. The leg is bent at 116 and is in contact with one terminal of a battery placed in the battery compartment. Similarly, the blade contact element 56 is also of an L-shaped configuration and one leg 115 thereof passes through the slot 46 into the battery compartment and functions similar to the leg 117 of the contact element 54. The remaining portions of the contact elements 54 and 56 are shaped differently. Contact element 56 has a contact lug 66 provided with a hole 70. This contact lug 66 is, upon assembly, in continuous contact with the female receptor 28 of electrical connector 24 via the electrically conductive fastening screw 18. Hole 72 is provided in battery holder 6 to permit screw 18 to pass through lug 66 into holder 6. A similar electrically conductive fastening screw 16 connects the electrical connector 22 to a contact ferrule 88, which is provided with a threaded hole 90 to receive the fastening screw 16. The fastening screw 18 is also assembled to a contact ferrule 92 as indicated in FIG. 4. It is the contact ferrule 92 which is in constant contact with the lug 66 when the battery pack is assembled.

The contact ferrule 88 is intermittently placed in contact with the blade contact element 54 at the contact lug area 64 by operation of the switch 10. As indicated previously, the switch 10, as more clearly shown in FIG. 2, has a switch blade 38 which extends downwardly from the switch body 36. The switch blade 38 is provided with a taper or cam surface 40 and a tang 106. The slot 52 in the front face 42 of the battery holder 6 is provided in order to accommodate the tang 106 and permit it to move within the slot 52. Thus the switch blade is guided in its movement so that the cam surface 40 will be brought into contact with the blade contact element 54 in a bodily uniform manner.

Figure 6:
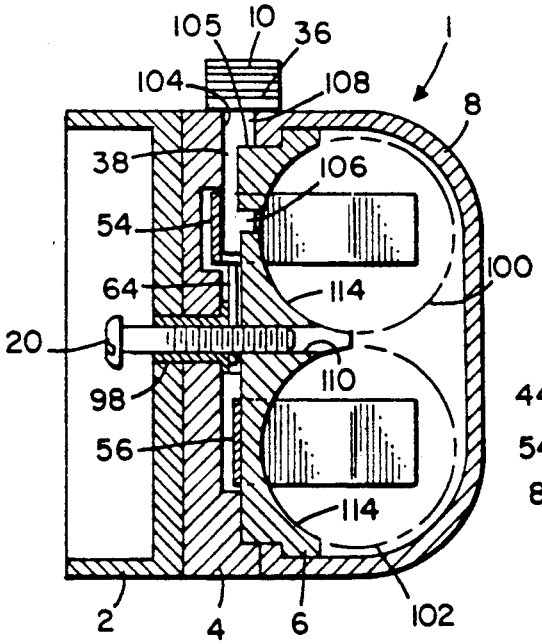
FIG. 6 is a cross-sectional view taken along line 6—6 of FIG. 1.

As more clearly shown in FIG. 6, the switch 10 is provided with a land 108 on the switch body portion 104 which bears upon a shelf 105 formed in the underside of the battery compartment 6. Thus, movement of the switch blade 38 in a translational manner is assured because of the guiding effect formed by the slot 52-tang 106 and land 108-shelf 105 combination. The upper part of the switch blade body portion 104 moves within a switch track 12 formed in the base plate 4. This base plate 4 is provided with the switch position indicator 14 as shown in FIG. 2, which may simply be a recessed area as more clearly shown in FIG. 3.

Figure 2:
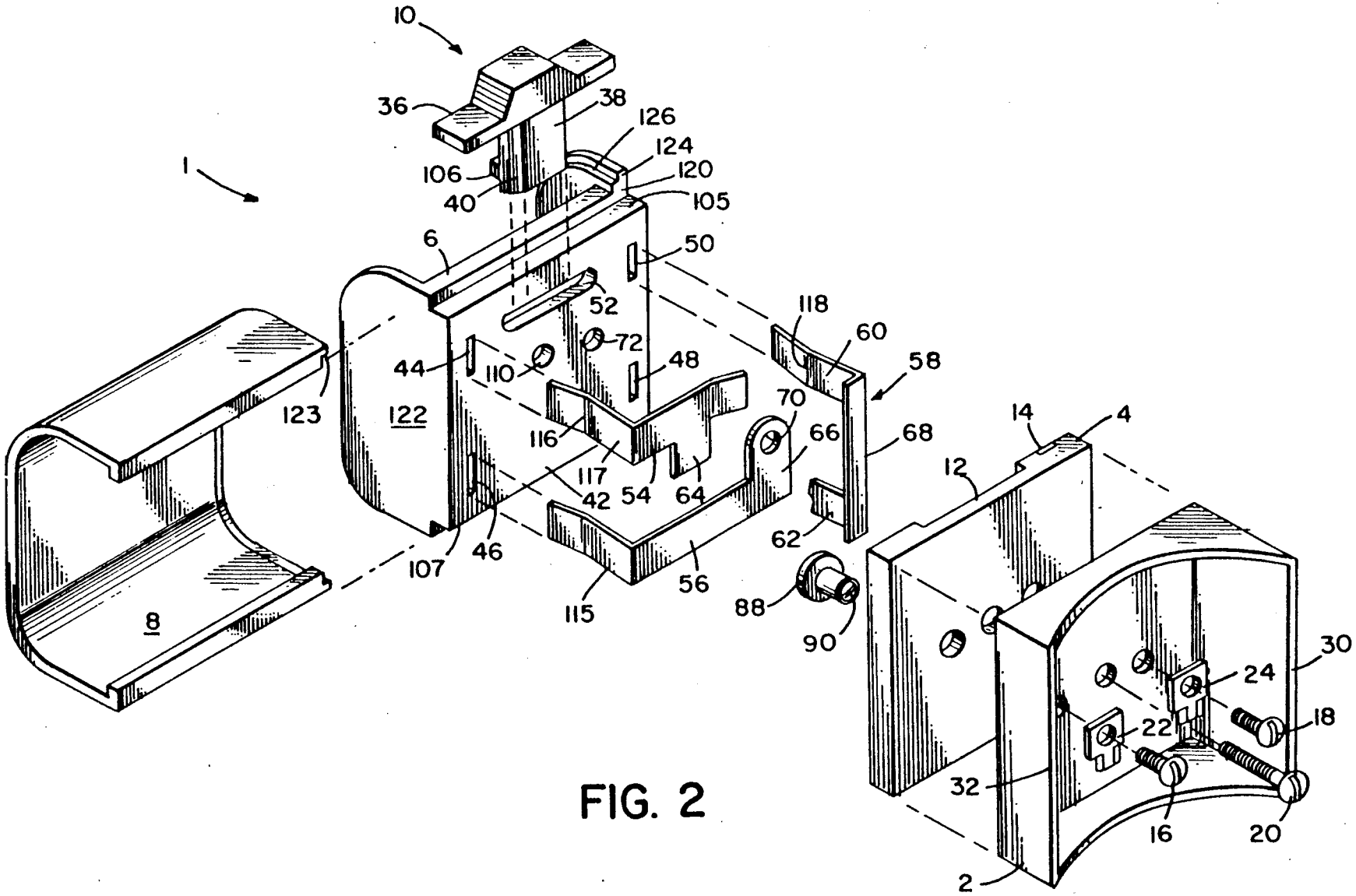
FIG. 2 is an exploded perspective view of the battery pack of FIG. 1.

When the switch blade cam surface 40 is moved to the left as viewed in FIG. 2, it will lift the contact lug 64 away from the front surface 42 and bring it into contact with the contact ferrule 88.

The battery holder 6 holds two batteries and the terminals of the two batteries are interconnected at their base by the contact spring 58. This contact spring is provided with the blade contact lugs 60 and 62 which pass through the slots 50 and 48 respectively into the battery compartment to touch appropriate terminals on the two batteries (not shown). These contacts are interconnected by the connector portion 68. Therefore, it is only the blade contact elements 54 and 56 which need to be electrically connected externally of the battery pack to the heater element.

Figure 5:
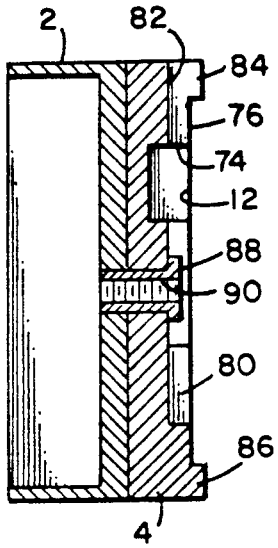
FIG. 5 is a cross-sectional view taken along line 5—5 of FIG. 4.
Figure 7:
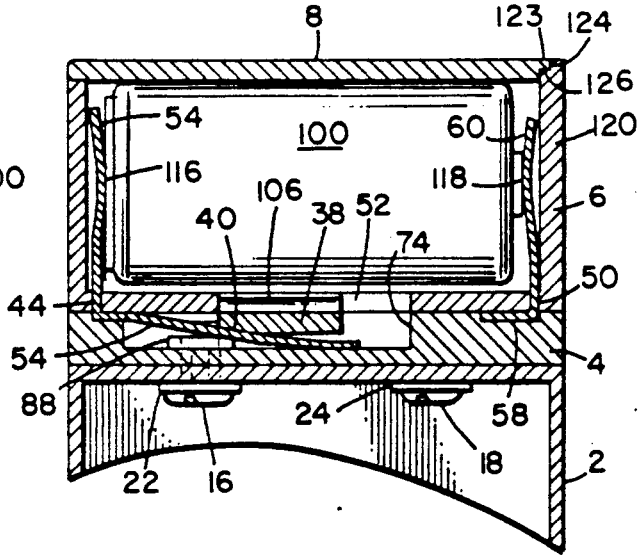
FIG. 7 is a cross-sectional view taken along line 7—7 of FIG. 1.

The base plate 4 is provided with a series of recesses or cutout areas in order to accommodate the several blade contact elements. This is more clearly shown in FIG. 4, wherein the cutout or recess areas 74, 76, 78, 80 and 82 are shown. The recess 74, as indicated in FIG. 5, is the deepest recess and it accommodates the blade contact element 54 and permits it to be moved within the recess 74 into and out of contact with the contact ferrule 88. The contact position is shown in FIG. 7 wherein the blade contact element 54 is seen as being depressed downwardly towards the ferrule 88 by means of the switch blade 38 and its cam surface 40 being moved towards the left as viewed in FIG. 7, and serving to urge the blade contact 54 downwardly.

The recess 76 is provided in order to form a mating surface to contact the surface 42 of the battery holder 6. The recess 78 accommodates the connector portion 68 of contact spring 58 extending between blade contacts 60 and 62. The recess 80 accommodates the blade contact element 56. The recess 82 serves as a contact surface for the backside of the switch blade 38. The extremities of the recess 82, where they meet the lands 84 form walls to delimit the end of the switch track 12, i.e., the limits of travel of the switch 12 is thus defined.

The base plate 4 is affixed to the bottom of the battery holder 6 such as by glueing or ultrasonic welding. In order to assure the relative correct positioning of parts, there is provided the upper shelf 105 and lower shelf 107 on the battery holder 6 with which the respective lands 84 and 86 of base plate 4 are in contact. The dimensioning is such that the base plate 4, when assembled to the battery holder 6, will still leave sufficient room on the lands 107, 105, for the battery compartment cover 8 to be slid into position.

As indicated previously, the contact ferrules are of metal and are pressed into openings in the base plate 4. The base plate 4 may be made of plastic to accommodate these ferrules in an electrically non-conducting manner. The ferrule 88 has a threaded hole 90 to accommodate the screw 16 and the ferrule 92 has a threaded hole 94 to accommodate the screw 18. A third ferrule 98 is provided which has a threaded hole 96 and which accommodates the mounting screw 20. Clearly, other forms of mounting the battery pack can be accommodated and the use of the mounting screw 20 is considered to be illustrative only of one form of accomplishing the mounting.

As shown in FIG. 6, the battery compartment is configured so as to accommodate batteries 100 and 102. This is accomplished by the recesses 114 which are formed in the battery holder 6. The battery holder 6 is further provided with the hole 110 which does not have threads but which permits the end of a long mounting screw to protrude into the battery compartment without interfering with the batteries themselves. The battery holder 6, as shown in FIG. 1, is formed with two end covers. The right end cover 120 and the left end cover 122 are of different sizes. The left end cover 122 is of smaller size in order to permit the cover 8 to slide over it towards the right end cover 120. The right end cover is arranged to accommodate the end of the cover 8. Cover 8 is formed with a lip 123 which is arranged to rest upon a land 126 formed in the reduced section 124 of the end cover 120.

Figure 10:
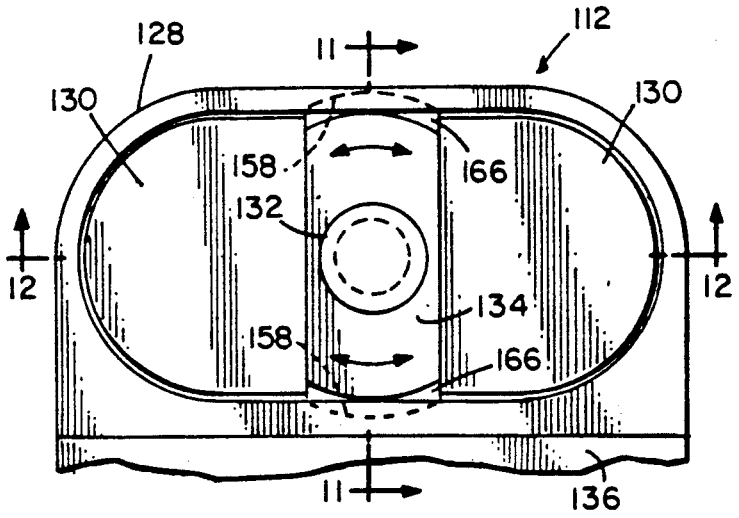
FIG. 10 is a side view of an alternate form of battery pack.
Figure 11:
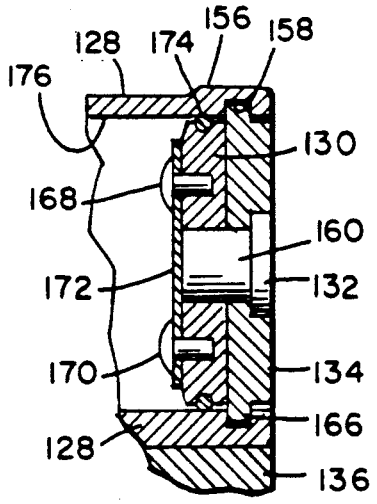
FIG. 11 is a partial sectional view taken along line 11—11 of FIG. 10.

An alternate form of battery pack 112 is shown in FIGS. 8 through 13. In this form of battery pack a rotary switch is employed which is sealed in order to prevent water from entering within the battery compartment. As shown in FIG. 10, the battery pack 112 comprises a battery housing 128 which is enclosed on three sides and which is open only at one end. That opening allows for the assembly of the batteries and is closed by the cover plate 130. The nature of this cover plate and the manner is which it is mounted is shown more clearly in FIGS. 10 and 11. The cover plate 130 is generally of oval configuration and is provided at its circumference with the O-ring 174 which is in intimate contact with the inner surface of the battery compartment 176. Rotatably affixed to the battery compartment cover plate 130 is a latch plate 134. The latch plate 134 is enabled to rotate on or with respect to the cover plate 130 by means of the pin 132. As shown in FIG. 11, this pin has a reduced section 160 which is cemented or otherwise fastened to the cover plate 130 so they are in fixed relationship with one another. However, the head of the pin 132 captures the latch plate 134 but is not affixed thereto. Therefore, the latch plate 134 can freely rotate on the pin 132.

The latch plate 134 is provided with the flange 166, which can be positioned within grooves 158 formed in the battery housing 128. As shown in FIG. 10, by rotating the latch plate 134 on pin 132, the flange 166 will be positioned within the groove 158 to prevent outward expulsion of the cover plate 130 to the right as viewed in FIG. 11. The cover plate 130 carries a battery contact plate 172 which enables interconnection of a positive and negative terminal of the two batteries within the compartment 176. As shown in FIG. 11, this battery contact plate 172 is held in place by a pair of plastic rivets 168 and 170. The end of the battery housing 128 is enlarged as at 156 in order to provide sufficient room to accommodate the retention means as just described.

The battery housing 128 has affixed to it, as by glueing or ultrasonic welding, a base plate 136 in the same manner as base plate 4 is affixed to the battery compartment 6. These two parts accommodate the switching mechanism between them similar to the arrangement shown in FIG. 2. However, in the embodiment of FIGS. 10–13, there is employed a switch which is generally in the form of a circular extended shaft. The actual switch actuating element is in the form of a semicircular shaft extension 138 of a switch shaft. Shaft extension 138 is provided with the ear 140 which extends only partly around the circumference of this extension. Formed between the ear 140 and a lower section 144 of the switch shaft is a groove 142. A second groove 146 is formed between the lower section 144 and upper section 148 of the switch shaft. The groove 146 accommodates the O-ring 178 as clearly shown in FIG. 9.

The switch shaft at its upper section 148 is provided with an operating handle 150 which has a relief flange 152. Normally, the switch shaft is rotated through 180° in order to position the shaft extension 138 into its on and off positions. It is readily seen from an examination of FIGS. 8 and 9 that the shaft 138, when being in the position of having its flattened surface beneath the spring contact 184, will permit it to be out of touch with the contact ferrule 212. When the handle 150 is lifted to the vertical position, one edge of the shaft extension 138 will be raised out of the plane of the surface 129 so that the contact extension 190 will be raised to be in contact with the ferrule 216.

Figure 13:
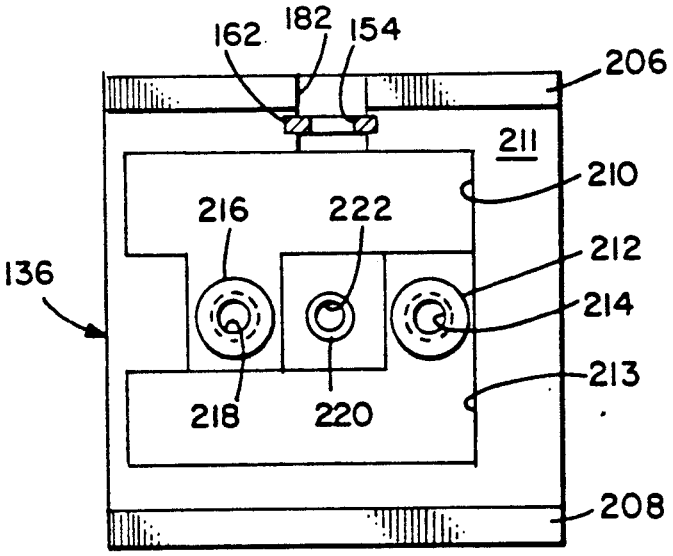
FIG. 13 is a sectional view similar to that of FIG. 4 but showing the base plate of the form of battery pack illustrated in FIGS. 9 through 12.

In order to prevent the rotary switch from being withdrawn from the housing in the normal mode of switch operation, a retention gland 154 is provided in the base plate 136. As seen in FIG. 13, the gland 154 is integrally formed in the base plate 136, which is molded of plastic.

Figure 9:
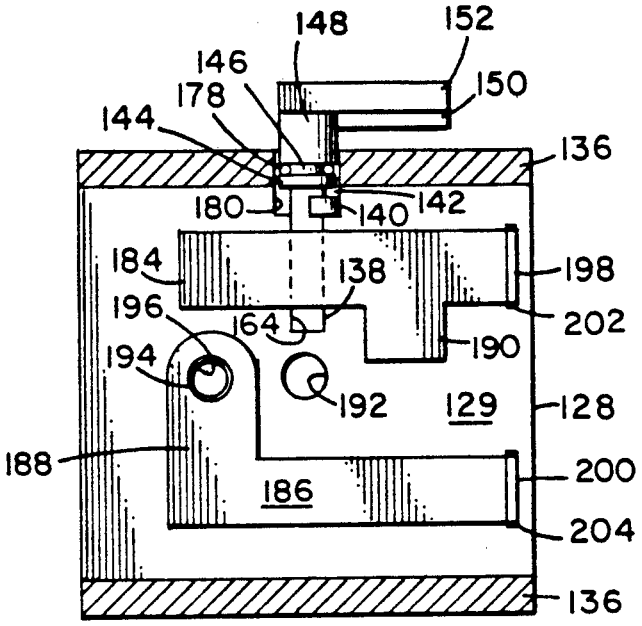
FIG. 9 is a cross-sectional view similar to FIG. 3 of the embodiment of FIGS. 1 through 7 showing the underside of a battery storage compartment employing the alternate form of switch element shown in FIG. 8.
Figure 12:
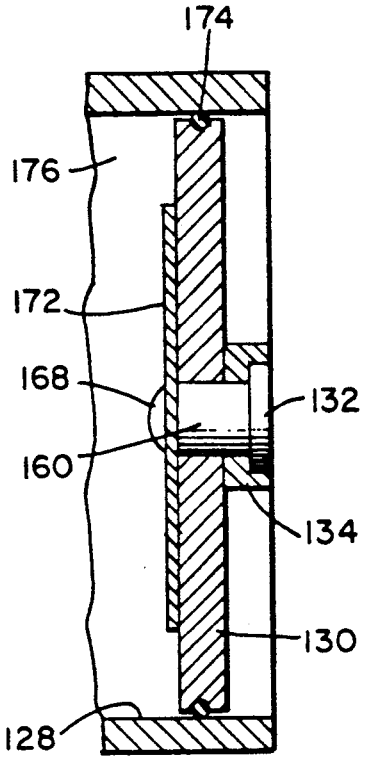
FIG. 12 is a partial sectional view taken along line 12—12 of FIG. 10.

As shown in FIG. 9, the battery compartment 128, at its lowermost surface 129, is provided with the slots 202 and 204. Passing through those slots are the contact legs 198 and 200 respectively, of the spring contacts 184 and 186 respectively. The battery housing 128 is provided with a semi-circular hole 180 in order to accommodate the switch shaft 148. This hole 180 has a reduced hole 164 leading from it in order to accommodate shaft extension 138. The extent of the hole 180 is such that it allows the ear 140 to rest at its lower end, where the reduced section 164 begins. The O-ring 178 is in contact with the walls of the hole 180 and is captured between the upper section 148 and lower section 144 of the switch shaft within the groove 146.

Figure 8:
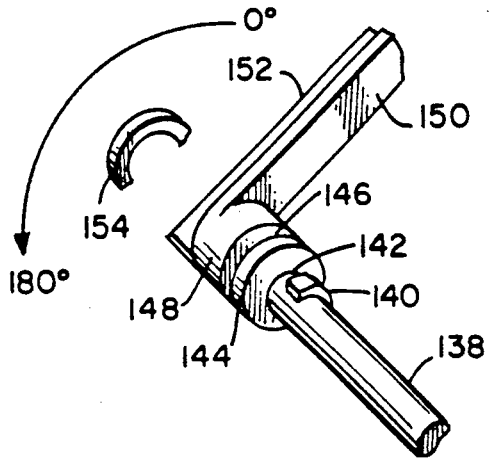
FIG. 8 is a perspective view of an alternate form of battery pack switch member.

In the position shown in FIG. 9, the flatted portion of the shaft extension 138 faces upwardly so that it is flush with the surface 129 of the battery housing 128. When the shaft is rotated so that the handle 150 moves from the right of FIG. 9 over towards the left of FIG. 9, one edge of the shaft extension 138 will be lifted up out of the plane of the surface 129 and will lift the spring contact 184 upwardly away from surface 129 to urge the contact extension 190 towards the contact ferrule 212. The base plate 136 is provided with a semi-circular hole 182 as shown in FIG. 13 in order to accommodate the shaft sections 144 and 148. The hole 182 has a groove 162 within it in order to receive the gland 154. As seen in FIG. 8, the gland 154 is in the form of half a cylindrical section so that its ends are arranged to be flush with the surface 211 of the base plate 136. The gland 154 is glued or otherwise affixed to the base plate 136 in order to be immobilized.

The base plate 136 is provided with the lands 206 and 208, which function in the same manner as the lands 84 and 86 of base plate 4. The base plate is cemented to the battery holder 136 at this area. The base plate 136 is provided with several recesses. Recess 210 is arranged to accommodate the spring contact 184 and recess 213 is arranged to accommodate the spring contact 186. Contact 186 is provided with the extension 188, which has the hole 194 therein.

A ferrule 220 is shown as being provided having a threaded hole 222, to receive a mounting bolt in the same manner as mounting bolt 20 of FIG. 2 so that the battery pack can be mounted to a shoe or boot. Hole 192 is provided in battery housing 128 to accommodate the mounting bolt.

Connection to a pair of electrical connectors such as 22, 24 in the embodiment of FIG. 2 is also provided in the alternate form of battery pack 112. The surface 211 of base plate 136 is provided with holes to provide for receiving the contact ferrule 212 which has the threaded hole 214 to accommodate a fastening screw which may pass through hole 194 in the spring contact 186 and extend into hole 196 in the battery housing 128. In a similar manner, the contact ferrule 216 is provided with the threaded hole 218 to accommodate a fastening screw.

While the invention has been described in connection with several embodiments, it is clear that various modifications and rearrangements of parts may be made without departing from the spirit and scope of the invention.

What is claimed is:

1. A battery pack adapted to be electrically connected to a footwear heating element, said battery pack comprising, a housing having a battery compartment adapted to receive at least one battery provided with a negative and a positive terminal, at least one pair of spring-like contact elements located in said compartment and arranged to be in physical contact one with the positive and the other with the negative terminal of said battery, a pair of fixed electrical contact elements arranged in said housing, one of said fixed electrical contact elements being in physical contact with one of said spring-like contact elements, the second of said fixed electrical contact elements being juxtaposed to the other member of said pair of said spring-like contact elements, and means arranged in said housing adapted to flex said spring-like contact element which is juxtaposed to said second of said fixed electrical contact elements so as to alternatively place said spring-like contact element into and out of engagement with said second of said fixed electrical contact elements.

2. The battery pack of claim 1 wherein said means includes a switch member slidably mounted within said housing which is provided with an actuating surface arranged to be selectively positioned to accomplish the flexing of said juxtaposed spring-like contact element.

3. The battery pack of claim 2 wherein said switch member includes a flat blade-like element provided with a cam surface which is slidably positionable to cause a portion of the juxtaposed spring-like contact element to move towards and away from said second of said fixed electrical contact elements.

4. The battery pack of claim 2 wherein said housing includes an on-off indicator means arranged to be displayed upon movement of said switch member.

5. The battery pack of claim 4 wherein said indicator means comprises a sector on the surface of said housing which is alternately covered and uncovered by movement of said switch into contact engaging and disengaging position respectively.

6. The battery pack of claim 1 wherein said means includes a switch member rotatably mounted within said housing which is provided with an actuating surface arranged to be selectively positioned to accomplish the flexing of said juxtaposed spring-like contact element.

7. The battery pack of claim 6 wherein said actuating surface is a flatted shaft positioned with its flatted section arranged in contact with a portion of the juxtaposed spring-like contact element, whereby when said shaft is rotated the non-flatted portion thereof causes the flexing of said spring-like contact element.

8. The battery pack of claim 6 wherein said housing is provided with a means which cooperates with said switch member to normally retain it within said housing, but when said switch member is rotated to a release position will permit bodily withdrawal of said switch member from said housing.

9. The battery pack of claim 6 wherein there is additionally provided a means cooperating with said switch member for inhibiting water penetration into said housing.

10. The battery pack of claim 1 wherein said housing is provided with a base member assembled to said battery compartment, said base member having depending sides which are trimmable to be made to conform to the surface of said footwear upon which the battery pack is to be mounted.

11. A battery pack adapted to be electrically connected to a footwear heating element, said battery pack comprising a housing having a battery compartment, and a skirt member arranged below said battery compartment, said skirt member having sides which are trimmable to be made to conform to the surface of said footwear upon which the battery pack is to be mounted.

* * * * *